US005192624A

United States Patent [19]

Morimoto

[11] Patent Number: 5,192,624

[45] Date of Patent: Mar. 9, 1993

[54] SOUND ABSORBING MATERIALS

[75] Inventor: Toru Morimoto, Chiba, Japan

[73] Assignee: Unix Corporation Ltd., Tokyo, Japan; a part interest

[21] Appl. No.: 688,996

[22] Filed: Apr. 12, 1991

[30] Foreign Application Priority Data

Apr. 26, 1990 [JP] Japan ..... 2-111488
Nov. 30, 1990 [JP] Japan ..... 2-334299

[51] Int. Cl.[5] ..... B32B 3/24; B32B 5/02; B32B 15/14; E04B 1/82

[52] U.S. Cl. ..... 428/596; 428/597; 428/608; 181/290; 181/291

[58] Field of Search ..... 428/596, 608, 607, 597, 428/624–626; 181/290, 291, 293, 292

[56] References Cited

U.S. PATENT DOCUMENTS

| | | | |
|---|---|---|---|
| 1,833,143 | 11/1931 | Weiss | 181/292 |
| 2,076,807 | 4/1937 | Burgess | 181/291 |
| 2,192,653 | 3/1940 | Schenk | 181/291 |
| 2,251,660 | 8/1941 | Chipley | 181/293 |
| 3,074,505 | 1/1963 | Schulz | 181/290 |
| 3,077,947 | 2/1963 | Peebles et al. | 428/257 |
| 3,509,671 | 5/1970 | Akerson | 181/293 |
| 3,597,891 | 4/1971 | Martin | 52/145 |
| 3,630,312 | 12/1971 | Woodward | 181/292 |
| 3,881,569 | 5/1975 | Evans, Jr. | 181/33 K |
| 4,194,329 | 3/1980 | Wendt | 181/291 |
| 4,310,068 | 1/1982 | Erskine | 181/290 |
| 4,828,932 | 5/1989 | Morimoto et al. | 428/608 |

FOREIGN PATENT DOCUMENTS

| | | | |
|---|---|---|---|
| 13513 | 7/1980 | European Pat. Off. | 181/291 |
| 3519153 | 12/1986 | Fed. Rep. of Germany . | |
| 2592416 | 7/1987 | France . | |
| 63/218227 | 9/1988 | Japan . | |

*Primary Examiner*—John Zimmerman
*Attorney, Agent, or Firm*—Young & Thompson

[57] ABSTRACT

The improved sound absorbing material comprises an aluminum base expanded metal (or an aluminum base metal screen) which is laminated with an aluminum base metal foil (or a thin resin film), or additionally with an aluminum base metal fiber layer. The aluminum base metal foil (or thin resin film) has ruptures, which vibrate in the process of sound absorption to permit the sound absorbing material to exhibit excellent sound-absorbing characteristics over a broad frequency range. The improved sound absorbing material can be produced by a process which comprises the steps of preparing a laminate comprising the members described above and pressing the laminate so that the individual members are compressed together while forming ruptures in a regular pattern in the aluminum base metal foil (or thin resin film).

15 Claims, 8 Drawing Sheets

SOUND ABSORBING MATERIALS

BACKGROUND OF THE INVENTION

1. Technical Field

This invention relates to sound absorbing materials having excellent sound-absorbing characteristics.

2. Background Art

A host of sound absorbing materials are used to control noise in various locations such as music halls, gymnasiums, construction sites and tunnels. The sound absorbing materials used for noise control purposes are versatile and include felts such as glass wool, rock wool and sponge, soft porous materials such as foamed resins comprising open cells, membranous materials such as vinyl sheets, porous boards such as soft fibrous boards, porous sintered boards, metal fiber boards and foamed metal boards, and perforated plates such as punched metals. These sound absorbing materials have their own merits and demerits in terms of sound-absorbing characteristics, weatherability, cost and fabrication method and suitable types are used in accordance with the specific use of interest.

In order to attain improved overall performance including sound-absorbing characteristics, composite systems in which two or more of the sound absorbing materials described are combined by lamination or some other suitable methods have been used commercially. Some of these composite sound absorbing materials exhibit satisfactory performance in sound-absorbing characteristics and weatherability in certain applications.

One major disadvantage of the prior art sound absorbing materials is that the frequency bands in which they exhibit satisfactory sound absorbing characteristics are narrow and that the absorption coefficients that are actually achieved are by no means satisfactory.

With the recent demand for improving the living conditions of people, there has been a growing need for reducing the level of noise exposure both indoors and outdoors. Under these circumstances, it is desired to develop sound absorbing materials having excellent sound-absorbing characteristics.

SUMMARY OF THE INVENTION

Therefore, the principal object of the present invention is to provide composite sound absorbing systems in which an aluminum base expanded metal or an aluminum base screen is laminated with an aluminum base metal foil and/or a thin resin film, or additionally with an aluminum base metal fiber layer. Since the aluminum base metal foil and/or the thin resin film have ruptures in their structure, the sound-absorbing characteristics of the composite systems per se are combined with the membranous vibrations of the ruptured aluminum base metal foil and/or the thin resin film to exhibit even better sound-absorbing characteristics. Further, the composite systems of the present invention are less expensive than the existing aluminum base composite sound absorbing systems.

In order to attain the aforementioned object, the present inventors conducted intensive studies and accomplished the present invention on the basis of the following observations.

As already mentioned, most of the commercial sound absorbing materials used today are porous but none of them are capable of attaining completely satisfactory sound-absorbing characteristics. Another known class of sound absorbing materials are adapted to absorb sound by creating vibrations in a smooth plane. However, the sound absorbing effect achieved by utilizing the vibration of a smooth plane is very low and the maximum attainable absorption coefficient has been on the order of 3–4%, which is too low to realize the commercial application of this concept.

As a result of the intensive studies conducted to solve these problems, the present inventors found that good sound-absorbing characteristics could be attained over a broad frequency range by using a thin film in a composite sound absorbing material and by making ruptures, preferably a regular pattern of ruptures, in the thin film. While the exact mechanism for this phenomenon is yet to be known, the probable reason would be as follows the ruptured portions of the thin film vibrate in the process of sound absorption to achieve good sound-absorbing characteristics, which are combined with the sound-absorbing characteristics exhibited by the resonant structure usually inherent in sound absorbing materials, and the resulting resonant vibration extends the frequency range over which satisfactory sound-absorbing characteristics can be attained, whereby the overall sound-absorbing characteristics are significantly improved.

As a result of their continued studies, the present inventors also found that by adding a conventional porous material, preferably one composed of aluminum base metal fibers, to the sound absorbing system consisting of an aluminum base expanded metal or aluminum base metal screen, and an aluminum base metal foil or a thin resin film, the frequency band over which sound could be effectively absorbed was extended and hence the overall sound-absorbing characteristics could be further improved.

According to a first embodiment of the present invention, there is provided a sound absorbing material in which an aluminum base expanded metal and/or an aluminum base metal screen is laminated with an aluminum base metal foil, which aluminum base metal foil has ruptures.

According to a second embodiment there is provided a sound absorbing material in which an aluminum base expanded metal and/or an aluminum base metal screen is laminated with an aluminum base metal fiber layer and an aluminum base metal foil, which aluminum base metal foil has ruptures.

According to a third embodiment, there is provided a sound absorbing material in which an aluminum base expanded metal and/or an aluminum base metal screen is laminated with a thin resin film, which resin film has ruptures.

According to a fourth embodiment, there is provided a sound absorbing material in which an aluminum base expanded metal and/or an aluminum base metal screen is laminated with an aluminum base metal fiber layer and a thin resin film, which resin film has ruptures.

DETAILED DESCRIPTION OF THE INVENTION

The sound absorbing materials according to the present invention are described in detail with reference to the preferred embodiments shown in the accompanying drawings.

Figure 1:
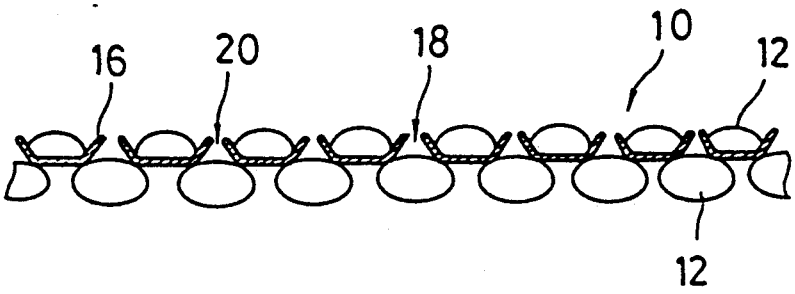
FIG. 1 is a schematic cross section showing an example of the sound absorbing material according to the first embodiment of the first aspect of the present invention.
Figure 2:
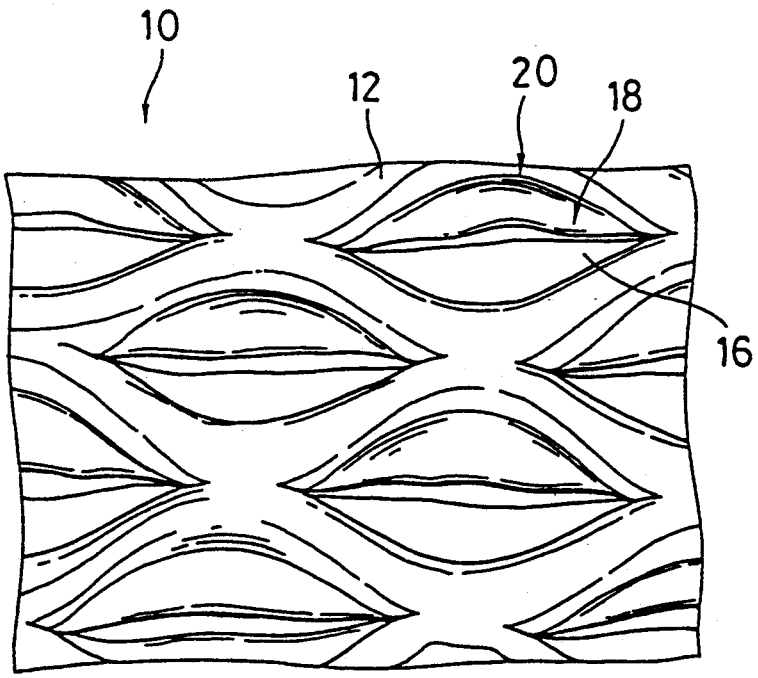
FIG. 2 is a sketch showing schematically the surface of the sound absorbing material shown in FIG. 1.

FIG. 1 is a schematic cross section showing an example of the sound absorbing material according to the first embodiment of the first aspect of the present invention, and FIG. 2 is a sketch showing schematically the surface of that sound absorbing material.

The sound absorbing material generally indicated by 10 is a laminate that consists basically of two layers of an aluminum (hereinafter abbreviated as Al) base expanded metal 12 and an Al base metal foil 16 sandwiched between them. The Al base metal foil 16 has ruptures 18, preferably in a substantially regular pattern across its surface in areas that correspond to openings 20 (see FIG. 3) made in the Al base expanded metal 12 as will be described below.

Figure 3:
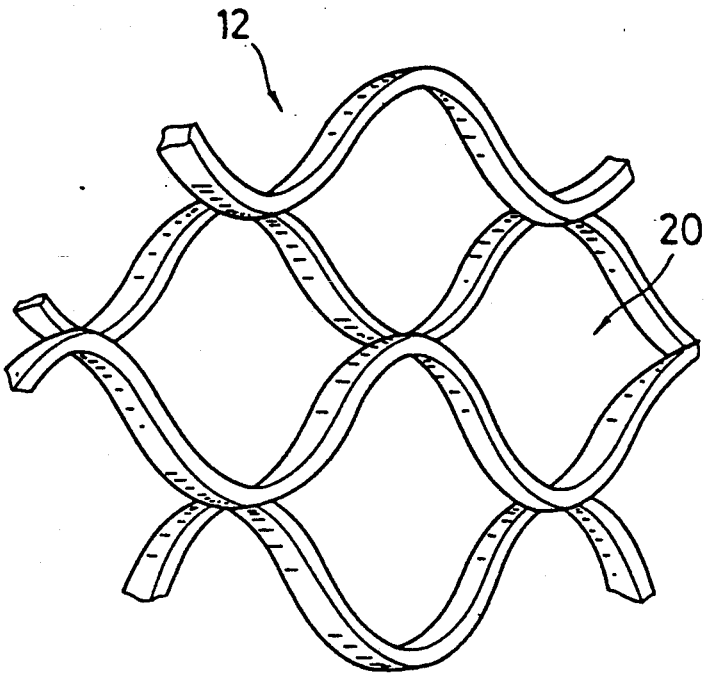
FIG. 3 is a schematic perspective view of an aluminum base expanded metal to be used in the present invention.

An expanded metal as it is used in the present invention is a sheet metal slotted and stretched in a direction generally perpendicular to the slots to make a network with openings 20 as basically shown in FIG. 3. In the present invention, an Al base expanded metal made from Al or Al base alloy is used.

As the slotted cross section of sheet metal is stretched, the expanded metal experiences torsion not only in a direction perpendicular to the plane surface but also in parallel and oblique directions, so good adhesion can be achieved by intertwining with the Al base metal foil 16 and, in the sound absorbing material according to the second embodiment to be described hereinafter, with an Al base metal fiber layer 14 via said Al base metal foil.

The size of openings 20 in the Al base expanded metal 12 differs with the degree Of working such as slotting and stretching. The degree of working on the Al base expanded metal 12 to be used in the present invention is not limited in any particular way and may be determined as appropriate in accordance with such factors as the adhesion to other members and the desired sound absorbing characteristics.

The thickness of the Al sheet to be used as the material for making the Al base expanded metal 12 is not limited to any particular value but it can advantageously be selected from the range of 0.2 mm to 1 mm.

In the sound absorbing material of the present invention, an Al base metal screen formed of Al or an Al base alloy may be used in place of the Al base expanded metal 12. There is no particular limitation on the Al base metal screens that can be used and various known types of Al base metal screens are applicable Particularly preferred are those Al base metal screens that have openings of 100–200 mesh and that consist of wires having diameters of 0.5–0.05 mm. Using such Al base metal screens, particularly preferred results can be attained in terms of sound-absorbing characteristics and the rate of production by the method to be described hereinafter.

If desired, the Al base expanded metal may be used in combination with the Al base metal screen. For example, referring to the case shown in FIG. 1, the Al base expanded metal 12 lying below the Al base foil 16 may be replaced by the Al base metal screen, or conversely, the Al base expanded metal 12 lying above the Al base foil 16 may be replaced by the Al base metal screen.

In the present invention, the Al base expanded metal and the Al base metal screen perform essentially the same function, so the following description is directed only to the use of the Al base expanded metal and the description of the case where the Al base metal screen is used is omitted.

The Al base metal foil 16 is a thin sheet of Al or an Al base alloy. The Al base metal foil 16 has ruptures 18 in at least part of it, preferably forming a substantially regular pattern of such ruptures across its surface in areas that correspond to openings 20 in the Al base expanded metal 12 as shown in FIGS. 1 and 2. Having such ruptures 18, the sound absorbing material 10 of the present invention, when it is in the process of sound absorption, causes membranous vibrations in the Al base metal foil 16 and in its ruptures 18, thereby achieving better sound-absorbing characteristics.

The thickness of the Al base metal foil 16 that can be used is not limited to any particular value but foils 4–50 μm thick are preferably used since not only do they achieve effective membranous vibrations but also a substantially regular pattern of ruptures 18 that correspond to openings 20 can be formed fairly easily, whereby excellent sound-absorbing characteristics are attained. More preferably, the Al base metal foil 16 has a thickness in the range of from about 5 to 30 μm.

The sound absorbing material 10 of the present invention having the structure described above can be manufactured by various methods for producing laminates. The preferred method comprises the steps of first preparing a laminate having the Al base metal foil 16 held between two layers of the Al base expanded metal 12 and then pressing the laminate in a continuous manner, preferably by means of rollers, so that the individual members are compressed together into a laminated sheet as shown in FIG. 1.

Stated more specifically, this method starts with sandwiching the Al base metal foil 16 between two layers of Al base expanded metal 12 to prepare a laminate and then the laminate is continuously pressed, preferably by means of rollers, to compress the individual members together into a laminated sheet. As the laminate is pressed the areas of the Al base metal foil 16 that correspond to openings 20 in the two layers of Al base expanded metal 12 between which the foil is sandwiched break apart to form ruptures 18 as shown in FIGS. 1 and 2.

By adopting this compression technique, the respective members of the laminate adhere to each other sufficiently strongly due to the ductility of Al so that the resulting laminated sheet can be cut to a suitable shape, or corrugated to have increased strength, or pressed to have an embossed surface, or otherwise worked to a desired shape in accordance with the equipment or environment in which said laminate is to be used. Further, as already mentioned, ruptures 18 are formed in the Al base metal foil 16 during compression in areas that correspond to openings 20 in the Al base expanded metal 12, so that as shown in FIGS. 1 and 2, a substantially regular pattern of ruptures 18 can be formed across the surface of the Al base metal foil 16, whereby the sound absorbing material 10 having satisfactory sound-absorbing characteristics can be realized.

There is no particular limitation on the pressure used to compress the individual members of the laminate to produce the sound absorbing material 10. However, in order to insure that the respective members adhere strongly to each other and that ruptures 18 are effectively formed across the surface of the Al base metal foil 16, the laminate is preferably compressed at pressures of ca. 300–2,000 kg/cm$^2$, more preferably ca. 500–1,500 kg/cm$^2$.

Further, in order to make sure that ruptures 18 will be formed in exact correspondence with openings 20, slots or other cuts may be preliminarily formed in the Al base metal foil 16 at desired positions.

Figure 4:
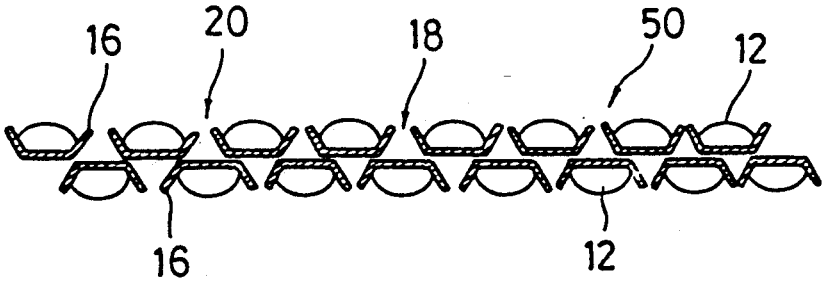
FIG. 4 is a schematic cross section showing another example of the sound absorbing material according to the first embodiment of the first aspect of the present invention.

In the sound absorbing material according to the first embodiment of the present invention, the number of Al base metal foils 16 is in no way limited to one as shown in FIG. 1 and, if desired, two Al base metal foils 16 may b; sandwiched between two layers of the Al base expanded metal 12 as in the sound absorbing material generally indicated by 50 in FIG. 4. In this arrangement, the combination of sound absorption by the membranous vibration of ruptures 18 and the sound absorbing effect of an ordinary resonant structure is doubled to provide even better sound-absorbing characteristics.

When two Al base metal foils 16 are used as in the sound absorbing material 50, ruptures 18 in one foil preferably do not overlap those in the other foil as shown in FIG. 4. This arrangement is effective for realizing even better sound-absorbing characteristics. In a particularly preferred case, the diameter of openings in one layer of the Al base expanded metal 12 is made different from that of openings in the other layer of expanded metal since this permits ruptures 18 to be formed in the two Al base metal foils 16 without overlapping each other.

When more than one Al base metal foil 16 is to be used, the thickness of individual foils may be the same or different.

The sound absorbing material using a plurality of Al base metal foils may be manufactured by the same method as used to produce the sound absorbing material 10 shown in FIG. 1.

Figure 5:
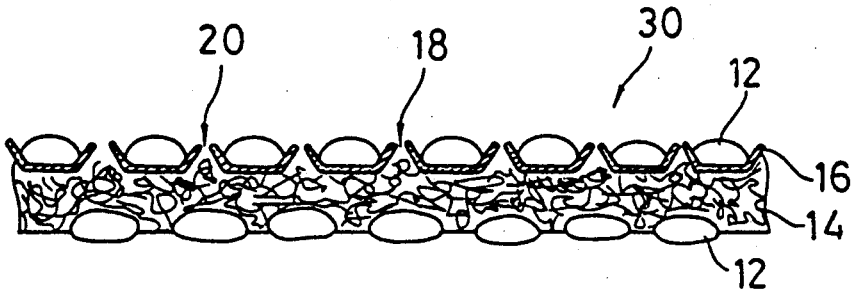
FIG. 5 is a schematic cross section showing an example of the sound absorbing material according to the second embodiment of the first aspect of the present invention.
Figure 6:
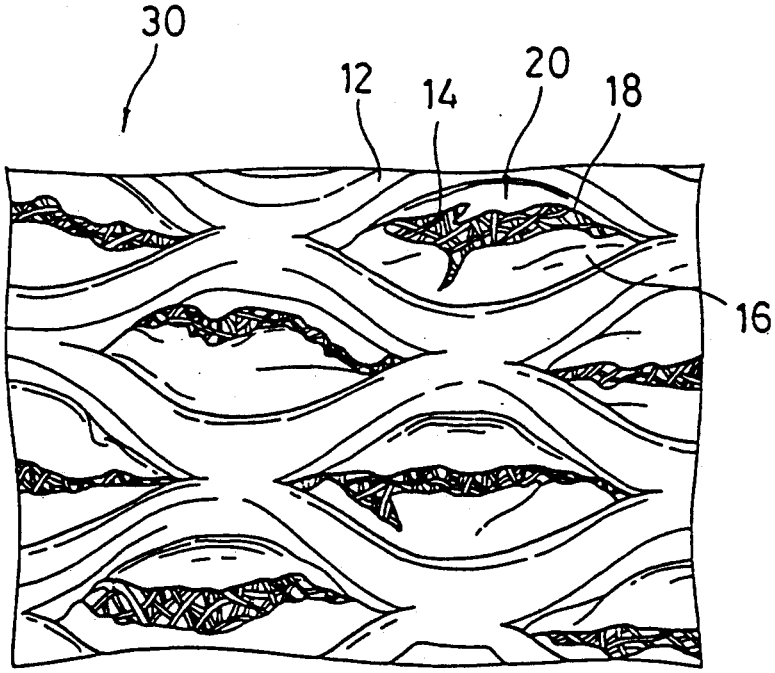
FIG. 6 is a sketch showing schematically the surface of the sound absorbing material shown in FIG. 5.

FIG. 5 is a schematic cross section showing an example of the sound absorbing material according to the second embodiment of the first aspect of the present invention, and FIG. 6 is a sketch showing schematically the surface of that sound absorbing material.

The sound absorbing material generally indicated by 30 is a laminate that consists basically of two layers of an Al base expanded metal 12 (or an Al base metal screen) and an Al base metal foil 16 and an Al base metal fiber layer 14 that are sandwiched between the two layers of Al base expanded metal. The Al base metal foil 16 has ruptures, preferably forming a substantially regular pattern across its surface in areas that correspond to openings 20 (see FIG. 6) made in the Al base expanded metal 12. Here, the Al base expanded metal 12 (Al base metal screen) and the Al base metal foil 16 are essentially the same as those used in the first embodiment described above and need not be described below in detail.

The sound absorbing material 30 according to the second embodiment of the present invention which has the structure described above is characterized by adding the Al base metal fiber layer 14 to the sound absorbing material according the first embodiment described hereinabove. Because of this arrangement, the sound absorbing material 30 is capable of absorbing sound in an even broader frequency range while exhibiting even better sound-absorbing characteristics.

Further, the Al base metal foil 16 has ruptures 18, so compared to the prior art sound absorbing material that is composed of an Al base expanded metal, an Al base metal foil and Al base metal fiber layer, the sound absorbing material 30 permits the use of a layer composed of a nonwoven cloth of Al base metal fibers that is thinner and smaller in a real density, whereby the cost and weight of the sound absorbing material can be reduced.

The Al base metal fiber layer 14 is a layer composed of metal fibers made from Al or an Al base alloy. While various types of Al or Al base metal fibers can be used, a nonwoven cloth of Al or Al base alloy fibers (which is hereinafter referred to as "a nonwoven cloth of Al base fibers") is preferably used.

A nonwoven cloth of Al base fibers is a fabric made by shaping Al base fibers in a layer form. The term "Al base fibers" collectively means Al or Al base alloy that are shaped into a fibrous form and that are Al shreds having a triangular, circular or any other desired cross-sectional shape, an effective diameter of ca. 50–250 μm and a length of at least 1 cm.

Two most commonly used methods for producing Al base fibers are (i) mechanical working by drawing into wires and (ii) spinning from molten Al.

Particularly preferred Al base fibers are those which are spun from a molten Al base metal chiefly composed of metallic Al; such Al base fibers are find and flexible enough to insure effective intermeshing with the Al base expanded metal so that the laminate can be bent or otherwise worked without causing find Al particles to nick or shed off to pollute the working environment.

The nonwoven cloth of Al base fibers can be produced by shaping those Al base fibers into a layer or fabric form. The nonwoven cloth of Al base fibers that can be used in the present invention can be produced by any shaping methods and not only nonwoven cloths that are manufactured from metal fibers obtained by cutting, grinding or other suitable methods but also those which are shaped by any other known methods can equally be used in the present invention. From an economic viewpoint, melt spinning methods that are commonly used today are particularly advantageous for the purpose of producing Al base fibers.

The a real density of the nonwoven cloth of Al base fibers that can be used in the present invention is not limited to any particular value and is typically in the range of ca. 550–1,650 g/m$^2$, preferably ca. 550–1,000 g/m$^2$, more preferably ca. 550 - 800 g/m$^2$. The sound absorbing material according to the second embodiment of the present invention has the advantage that its sound-absorbing characteristics can be adjusted by controlling the a real density of the nonwoven cloth of Al base fibers. For example, the sound-absorbing characteristics in the low frequency range can be improved by increasing the a real density of the nonwoven cloth of Al base fibers.

The thickness of the nonwoven cloth of Al base fibers that can be used in the present invention is not limited to any particular value and may be determined as appropriate for the desired sound absorbing characteristics of the sound absorbing material of interest.

In the sound absorbing material 30 according to the second embodiment of the present invention, the Al base metal foil 16 may be provided on only one side of the Al base metal fiber layer 14 as shown in FIG. 5, or alternatively, two Al base metal foils 16 may be provided, one on each side of the Al base metal fiber layer 14.

The sound absorbing material 30 of the present invention having the structure described above can be manufactured by various methods for producing laminates. As in the first embodiment, the preferred method comprises the steps of first superposing the respective members in a predetermined order to prepare a laminate and then pressing the laminate in a continuous manner, preferably by means of rollers, so that the individual members are compressed together into a laminated sheet as shown in FIGS. 5 and 6.

There is no particular limitation on the pressure used to compress the individual members of the laminate to produce the sound absorbing material 30 according to the second embodiment of the present invention. However, in order to insure that the respective members adhere strongly to each other and that ruptures 18 are effectively formed across the surface of the Al base metal foil 16, the laminate is preferably compressed at pressures of ca. 300–2,000 kg/cm$^2$, more preferably ca. 500–1,500 kg/cm$^2$.

Further, as in the first embodiment, in order to make sure that ruptures 18 will be formed in exact correspondence with openings 20, slots or other cuts may be preliminary formed in the Al base metal foil 16 at desired positions.

In addition, the thickness of the sound absorbing material 30 may be adjusted by controlling the pressure to be applied to the laminate and this is another way to adjust the sound absorbing characteristics of the material 30.

The sound absorbing material according to the third embodiment of the first aspect of the present invention i basically an assembly of the two layers of an Al base expanded metal and/or an aluminum base metal screen and a thin resin film that is sandwiched between those two layers and that has ruptures in its structure. The sound absorbing material according to the fourth embodiment of the present invention is basically an assembly of two layers of an Al base expanded metal and/or an aluminum base metal screen and an Al base metal fiber layer and a thin resin film that are sandwiched between those two layers, with the thin resin film having ruptures in its structure The sound absorbing materials according to the third and fourth embodiments are the same as the sound absorbing materials according to the first and second embodiments, respectively, except that the Al base metal foil 16 is replaced by a thin resin film, preferably a thin fluoroethylene resin film and/or a thin polyvinylidene resin film. The other aspects of the sound absorbing materials according to the third and fourth embodiments are identical to the sound absorbing materials according to the first and second embodiments, so the following description is directed only to the thin resin film and the description of the other aspects will be omitted.

The thin resin film to be used in the present invention may be selected from among any known thin resin films including thin films of vinyl chloride resins, polyethylene resins, polypropylene resins, fluoroethlene resins, polyvinylidene resins and acrylic resins Among these, thin films of fluoroethylene resins and polyvinylidene resins are particularly advantageous from the viewpoints of sound-absorbing characteristics, weatherability and durability.

Any known types of fluoroethylene resins may be used in the present invention as the material for the thin film of fluoroethylene resins and the following may be listed as advantageous examples (i) polytetrafluoroethylene (PTFE)

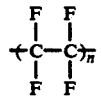

(ii) tetrafluoroethylene-hexafluoropropylene copolymer

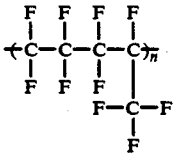

(iii) ethylene-tetrafluoroethylene copolymer (ETFE)

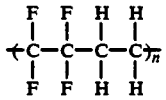

(iv) polychlorotrifluoroethylene

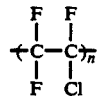

These fluoroethylene resins are nonflammable and have high chemical, weather and heat resistance.

Any known types of polyvinylidene resins may be used in the present invention as the material for the thin film of polyvinylidene resins and the following may be listed as advantageous examples:

(i) polyvinylidene difluoride

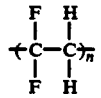

(ii) polyvinylidene cyanide

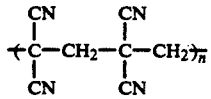

These polyvinylidene resins have high chemical and weather resistance.

As in the cases shown in FIGS. 1 and 4, the thin resin film used in the third and fourth embodiments of the present invention has ruptures in at least part of it, preferably across the surface of the Al base expanded metal in areas that correspond to the openings in it. This arrangement offers the advantage that in the process of sound absorption, membranous vibrations take place in the thin resin film and its ruptures, thereby achieving better sound-absorbing characteristics.

The thickness of the resin film that can be used is not limited to any particular value but in order to achieve effective membranous vibrations and realize satisfactory sound-absorbing characteristics, the resin film typically has a thickness of ca. 4–70 μm, preferably ca. 4–50 μm, more preferably ca. 4–30 μm.

The sound absorbing materials according to the third and fourth embodiments can be produced by essentially the same method as used in the first and second embodiments. The preferred method comprises the steps of first superposing the respective members in a desired order to prepare a laminate and then pressing the laminate in a continuous manner, preferably by means of rollers, so that the individual members are compressed together into a laminated sheet.

Resin films such as those made of fluoroethylene resins or polyvinylidene resins are not as easy as the Al base metal foil 16 to form ruptures 18 solely by means of compression. Under these circumstances, it is preferred to adopt means that help form ruptures in positions that correspond to openings 20 by subsequent working. Examples of such means are the method of providing slits in positions that correspond to openings 20 in the Al base expanded metal 12 and the method of providing cuts in the surface that will lead to ruptures in subsequent working.

There is no particular limitation on the pressure used to compress the individual members of the laminate to produce the sound absorbing materials according to the third and fourth embodiments. However, in order to insure that the respective members adhere strongly to each other and that ruptures are effectively formed across the surface of the thin resin film, the laminate is preferably compressed at pressures of ca. 300–2,000 kg/cm$^2$, more preferably ca. 500 –1,500 kg/cm$^2$.

In the third and fourth embodiments of the present invention, various adhesive may optionally be used as auxiliary means to insure better adhesion between the thin film of resins such as fluoroethylene resins and polyvinylidene resins and the Al base expanded metal and the Al base metal fiber layer (in the case of the fourth embodiment).

In any of the four embodiments of the present invention described above, both the Al base metal foil and the thin resin film may be used together to make the sound absorbing material.

While four embodiments of the sound absorbing materials of the present invention have been described in detail on the foregoing pages, it should of course be noted that the present invention is by no means limited to these embodiments alone and various improvements and modifications can be made without departing from the scope and spirit of the invention.

EXAMPLES

The following examples are provided for the purpose of further illustrating the present invention but are by no means to be taken as limiting. The structural features of the sound absorbing materials constructed in the following Examples 1–5 are summarized in Table 1 at the end of the description of Example 5.

EXAMPLE 1

Four samples of sound absorbing material were constructed by the methods described below.

Sound absorbing material I-1 (sample of the invention)

(i) Al base expanded metal 0.4 mm thick (the size of opening 20: 3 mm across the shorter side; 4 mm across the longer side);
(ii) Al base metal foil 6 μm thick; and
(iii) same as (i).

Each of the members (i), (ii) and (iii) measured 1 m × 1 m wide and the thickness of the three members in superposition was 0.8 mm.

The members (i), (ii) and (iii) were superposed one on another in the order shown in FIG. 1 and compressed together by pressing at 0.7 tons/cm$^2$ form a laminated sheet 0.5 mm thick.

Examination of the surface of the laminated sheet under an optical microscope at a magnification of 60 revealed that ruptures had formed in a substantially regular pattern across the surface in correspondence with openings 20 in the Al base expanded metal. It was also verified that the laminated sheet was a sound absorbing material of the type indicated by 10 in FIGS. 1 and 2 which was within the scope of the present invention.

Sound absorbing material II-1 (comparative sample)

Members (i), (ii) and (iii) that were the same as those used in sound absorbing material I-1 were superposed and fixed in a normal-incidence sound-absorption tube, to thereby construct sound absorbing material II which was the same as I-1 except that the Al base metal foil had no ruptures in its structure.

Sound absorbing material III-1 (sample of the invention

This sound absorbing material was the same as I-1 except that member (iv), or a nonwoven Al cloth having an a real density of 550 g/m$^2$ (Al fiber diameter, 100 μm)), was placed between (ii) and (iii). Each of the members (i)–(iv) measures 1 m ×1 m wide and the thickness of the four members in superposition was 9.5 mm.

The members (i), (ii), (iii) and (iv) were superposed one on another in the order shown in FIG. 4 and compressed together by pressing at 0.7 tons/cm$^2$ to form a laminated sheet 0.9 mm thick.

Examination of the surface of the laminated sheet under an optical microscope at a magnification of 60 revealed that ruptures had formed in a substantially regular pattern across the surface in correspondence with openings 20 in the Al base expanded metal. It was also verified that the laminated sheet was a sound absorbing material of the type indicated by 30 in FIGS. 4 and 5 which was within the scope of the present invention.

Sound absorbing material IV-1 (comparative sample)

A laminated sheet having a thickness of 0.9 mm was constructed in entirely the same was as III-1 except that the Al base metal (ii) was not used.

The absorption coefficients of the respective sound absorbing materials, I-1, II-1, III-1 and IV-1, were measured by a normal-incidence sound absorption method for construction materials (see JIS—the Japanese Industrial Standards—1405-1063) with an air layer (50 mm) provided at the back of each material. The results are shown in FIG. 7.

Figure 7:
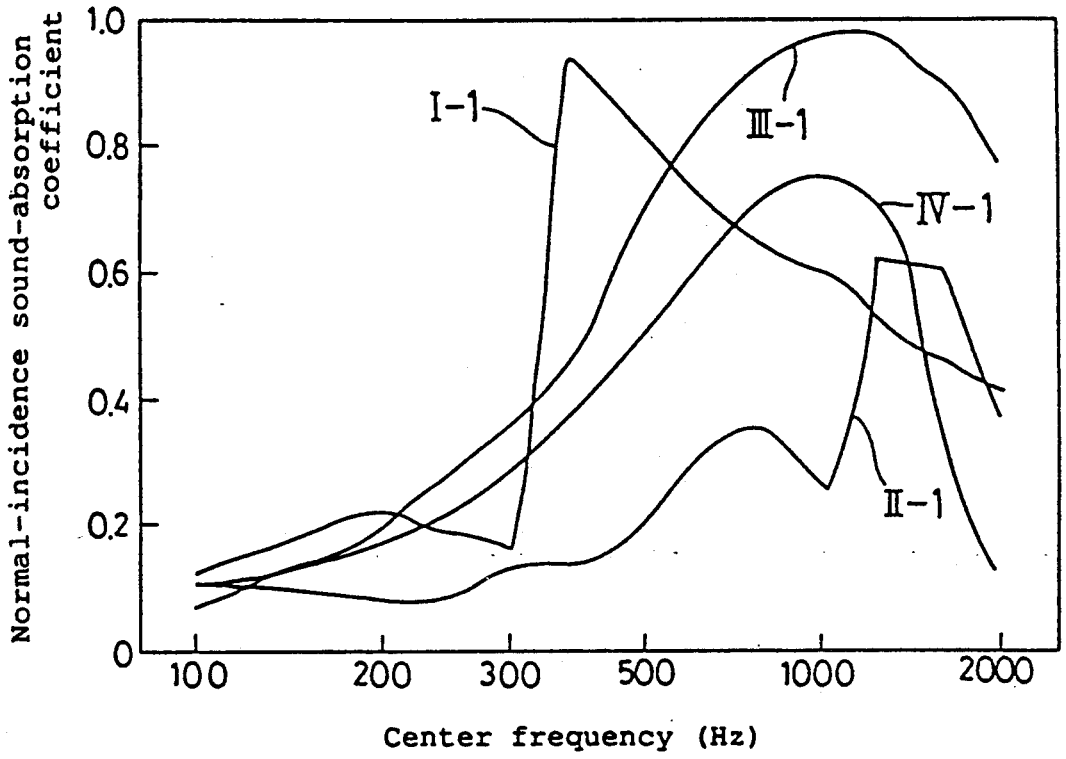
FIGS. 7–11 are graphs showing the sound-absorbing characteristics of various sound absorbing materials measured by a normal-incidence sound absorption method.

As is clear from FIG. 7, sound absorbing materials I-1 and III-1 having a ruptured Al foil in accordance with the present invention exhibited better sound-absorbing characteristics than the prior art sound absorbing materials II-1 and IV-1.

EXAMPLE 2

Sound absorbing material I-2 (sample of the present invention), II-2 (comparative sample), III-2 (sample of the present invention) and IV-2 (comparative sample equivalent to IV-1) were constructed by repeating the procedure of Example 1 except that the Al base metal foil (ii) having a thickness of 6 μm was replaced by an Al base metal foil having a thickness of 15 μm.

As in Example 1, the surface of each sound absorbing material was examined under an optical microscope at a magnification of 60. It was found that ruptures had formed in a substantially regular pattern across the surface of the Al base metal foil in correspondence with the openings in the Al base expanded metal used in the samples of the present invention.

The absorption coefficients of the respective sound absorbing materials were measured by a normal-incidence sound absorption method for construction materials (JIS 1405-1963) with an air layer (50 mm) provided at the back of each material. The results are shown in FIG. 8.

Figure 8:
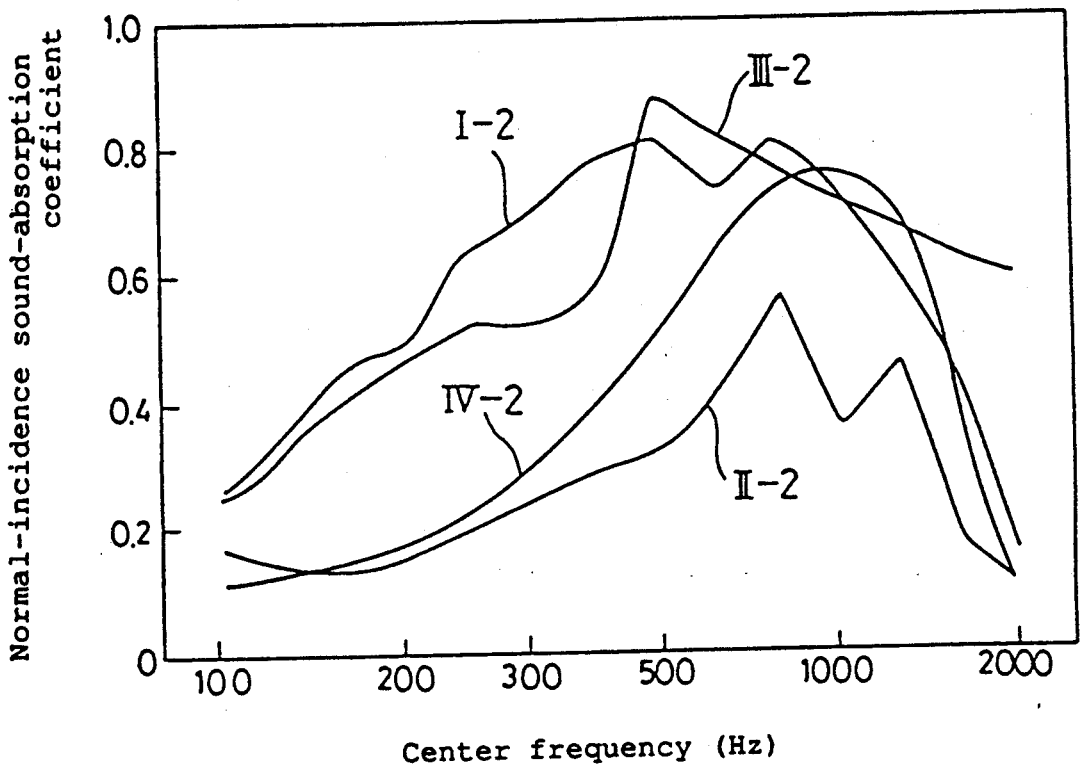

It is clear from FIG. 8 that as in Example 1, sound absorbing materials I-2 and III-2 having ruptures in the Al foil in accordance with the present invention exhibited better sound-absorbing characteristics than the prior art sound absorbing materials II-2 and IV-2.

EXAMPLE 3

Sound absorbing materials I-3 (sample of the present invention), II-3 (comparative sample), III-3 (sample of the present invention) and IV-3 (comparative sample equivalent to IV-1) were constructed by repeating the procedure of Example 1 except that the Al base metal foil (ii) having a thickness of 6 μm was replaced by a thin PTFE film 6 μm thick ("Aflex ®" of Asahi Glass Co., Ltd.)

As in Example 1, the surface of each sound absorbing material was examined under an optical microscope at a magnification of 60. It was found that ruptures had formed in a substantially regular pattern across the surface of the PTFE film in correspondence with the openings in the Al base expanded metal used in the samples of the present invention.

The absorption coefficients of the respective sound absorbing materials were measured by a normal-incidence sound absorption method for construction materials (JIS 1405-1963) with an air layer (50 mm) provided at the back of each material. The results are shown in FIG. 9.

Figure 9:
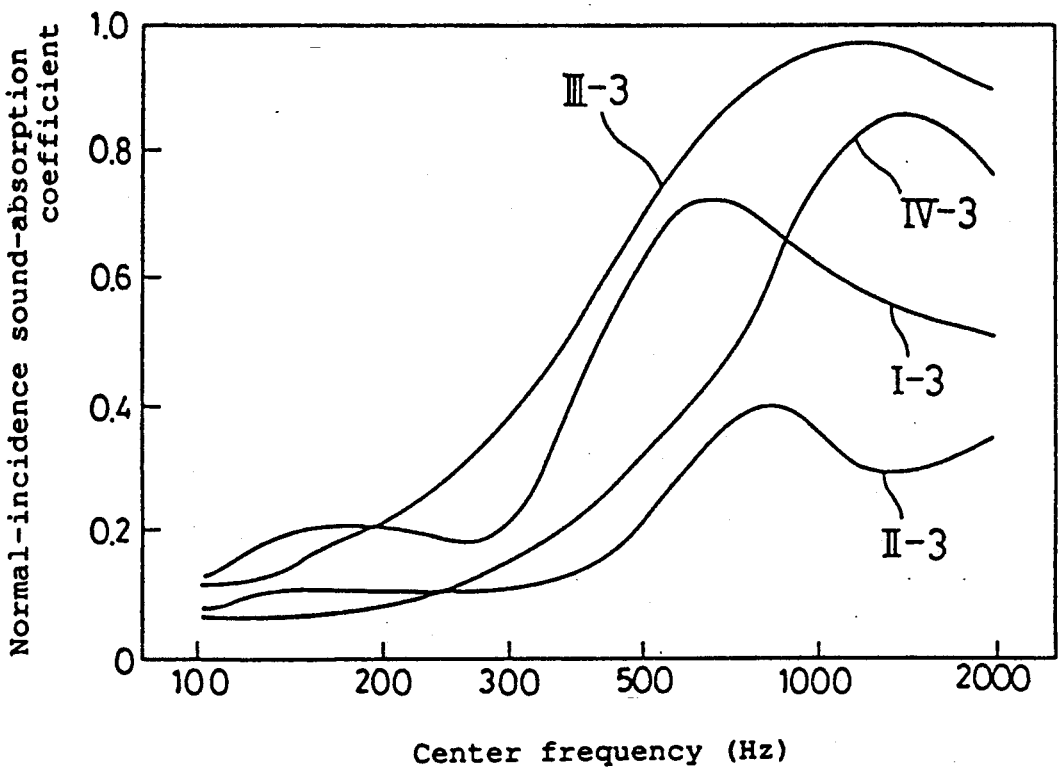

It is clear from FIG. 9 that as in Examples 1 and 2, sound absorbing materials I-3 and III-3 having ruptures in the PTFE film in accordance with the present invention exhibited better sound-absorbing characteristics than the prior art sound absorbing materials II-3 and IV-3.

Example 4

Four samples of sound absorbing material were constructed by the methods described below.

Sound absorbing material I-4 (sample of the invention (i) Al base expanded metal 0.4 m thick (the size of opening 20: 3 mm across the shorter side; 4 mm across the longer side);
(ii) Al base metal foil 12 μm thick;
(iii) Al base metal foil 12 μm thick: and
(iv) same as (i).

Each of the members (i), (ii), (iii) and (iv) measured 1 m × 1 m wide and the thickness of the three members in superposition was 1.2 mm.

The members (i)–(iv) were superposed one on another in the order shown in FIG. 4 and compressed together by pressing at 0.7 tons/cm$^2$ to form a laminated sheet 0.8 mm thick.

Examination of the surface of the laminated sheet under an optical microscope at a magnification of 60 revealed that ruptures had formed in the Al base metal foils (ii) and (iii) in a substantially regular pattern across their surface in correspondence with openings 20 in the Al base expanded metal. It was also verified that ruptures 18 in the two Al base metal foils did not overlap each other and, therefore, that the laminated sheet was a sound absorbing material of the type indicated by 50 in FIG. 4 which was included within the scope of the present invention.

Sound absorbing material II-4 (comparative sample)

A laminated sheet having a thickness of 1.2 mm was constructed in entirely the same manner as sound absorbing material I-4 except that no ruptures were formed in the Al base metal foils (ii) and (iii). Sound absorbing material III-4 (sample of the present A laminated sheet having a thickness of 0.8 mm was constructed in entirely the same manner as sound absorbing material I-4 except for the following two points: member (ii) was changed to an Al base metal foil having a thickness of 20 μm; and member (iii) was changed to a thin PTFE film having a thickness of 20 μm ("Aflex ®" of Asahi Glass Co , Ltd which had been slotted with a grid pattern of slits 4 mm long that were spaced apart by 4 mm in both a horizontal and a vertical direction).

Examination of the surface of the laminated sheet under an optical microscope at a magnification of 60 revealed that ruptures had formed in the Al base metal foil (ii) and the thing PTFE film (iii) in a substantially regular pattern across their surface in correspondence with openings 20 in the Al base expanded metal, which indicated that the laminated sheet was a sound absorbing material within the scope of the present invention. It was also verified that ruptures 18 in the Al base metal foil (ii) and the thin PTFE film (iii) did not overlap each other.

Sound absorbing material IV-4 (comparative example)

A laminated sheet having a thickness of 1.2 mm was constructed in entirely the same manner as sound absorbing material I-4 except that no ruptures were formed in the Al base metal foil (ii) or the thin PTFE film (iii).

The absorption coefficients of the respective sound absorbing materials were measured by a normal-incidence sound absorption method for construction materials (JIS 1405-1963) with an air layer (50 mm) provided at the back of each material. The results are shown in FIG. 10.

Figure 10:
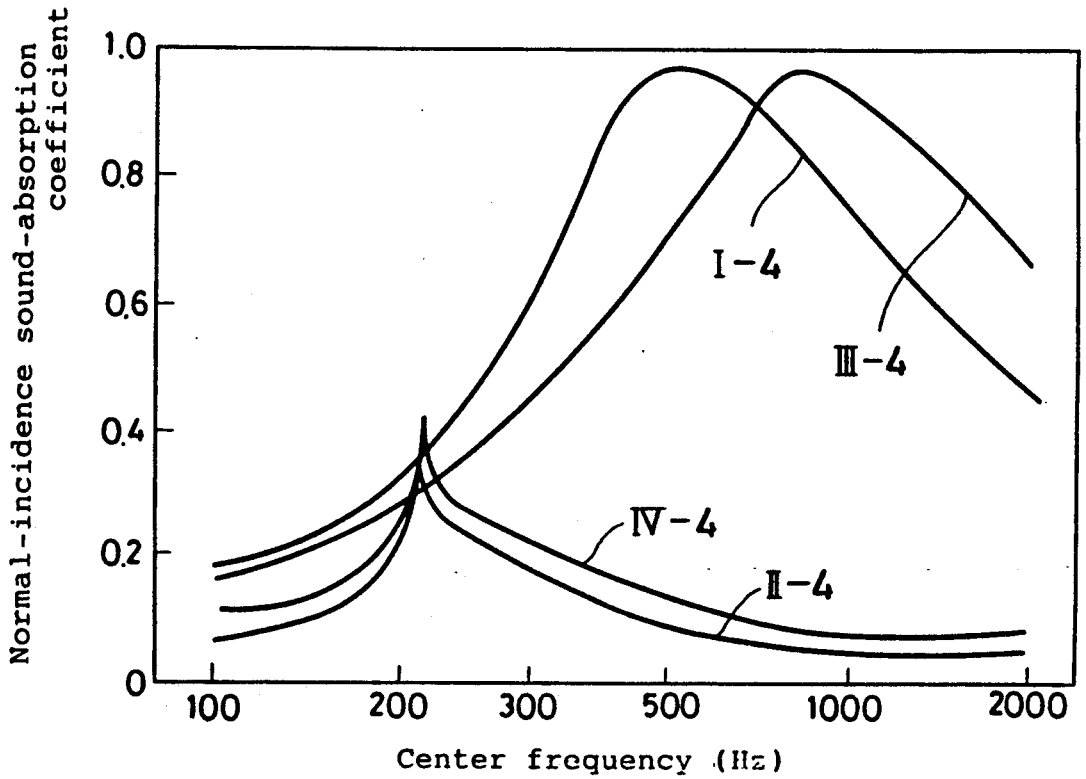

It is clear from FIG. 10 that as in Examples 1-3, sound absorbing materials I-4 and III-4 having ruptures in the Al base metal foil and/or thin PTFE film in accordance with the present invention exhibited better sound-absorbing characteristics than sound absorbing materials II-4 and IV-4 which had not such ruptures.

EXAMPLE 5

Two samples of sound absorbing material were constructed by the methods described below.

Sound absorbing material I-5 (sample of the invention)

(i) Al base expanded metal 0.4 mm thick (the size of opening 20: 3 mm across the shorter side; 4 mm across the longer side);
(ii) Al base metal foil 12 μm thick;
(iii) nonwoven Al cloth having an a real density of 550 g/m$^2$ (Al fiber diameter, 100 μm);
(iv) thin PTFE film 20 μm thick ("Aflex®" of Asahi Glass Co., Ltd. which had been slotted with a grid pattern of slits 4 mm long that were spaced apart by 4 mm in both a horizontal and a vertical direction); and
(v) same as (i).

Each of the members (i), (ii), (iii), (iv) and (v) measured 1 m × 1 mm wide and the thickness of the five members in superposition was 2.5 mm.

The members (i)-(v) were superposed one on another in the order shown in FIG. 1 and compressed together by pressing at 0.7 tons/cm$^2$ to form a laminated sheet 0.85 mm thick.

Examination of the surface of the laminated sheet under an optical microscope at a magnification of 60 revealed that ruptures 18 had formed in the Al base metal foil (ii) and the thin PTFE film (iv) in a substantially regular pattern across their surface in correspondence with openings 20 in the Al base expanded metal, which indicated that the laminated sheet was a sound absorbing material within the scope of the present invention. It was also verified that ruptures 18 in the Al bas metal foil (ii) and the thin PTFE film (iv) did not overlap each other.

Sound absorbing material II-5 (comparative sample)

A laminated sheet having a thickness of 0.85 mm was constructed in entirely the same manner as sound absorbing material I-5 except that no ruptures were formed in the Al base metal foil (ii) and the thin PTFE film (iv).

The absorption coefficients of the respective sound absorbing materials were measured by a normal-incidence sound absorption method for construction materials (JIS 1405-1963) with an air layer (50 mm) provided at the back of each material. The results are shown in FIG. 11.

Figure 11:
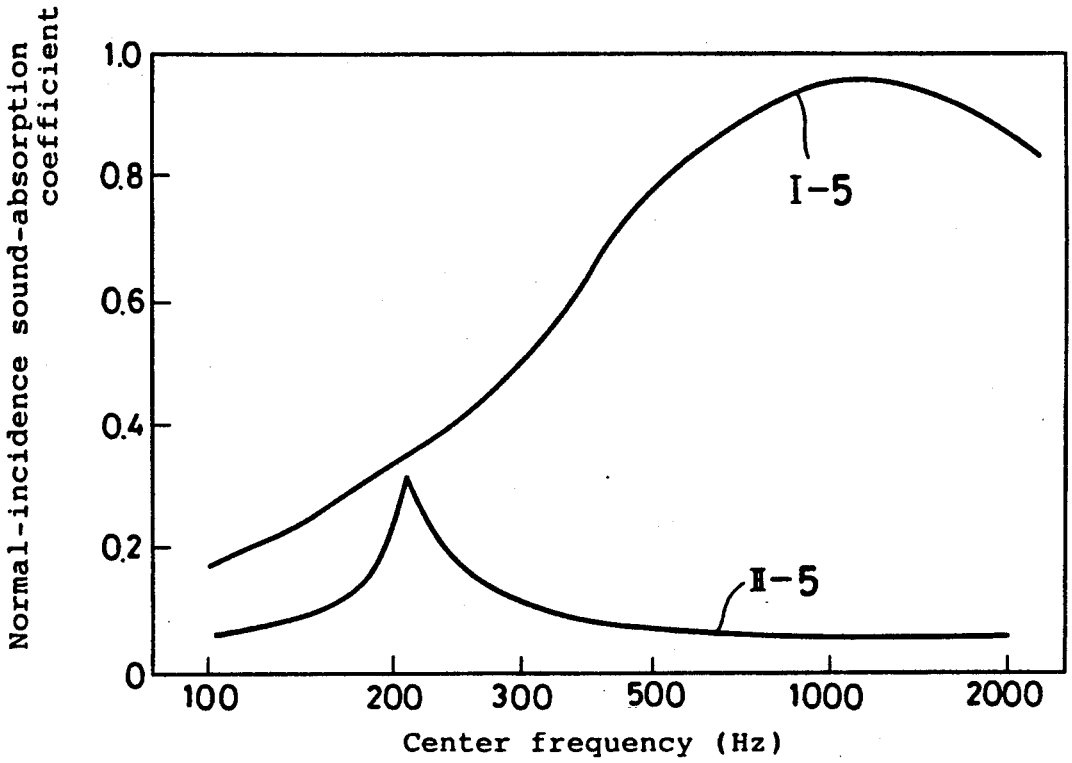

It is clear from FIG. 11 that as in Examples 1-4, sound absorbing material I-5 having ruptures in the Al base metal foil and the thin PTFE film in accordance with the present invention exhibited better sound-absorbing characteristics than sound absorbing material II-5 which had no such ruptures.

The structural features of the sound absorbing materials constructed in Examples 1-5 are summarized in Table 1 below.

TABLE 1

| Example | Sample | Al base metal foil and/or thin resin film | Ruptures | Porous member |
|---|---|---|---|---|
| 1 (FIG. 7) | I-1 (Ex) | Al foil (6 μm) | yes | none |
| | II-1 (CEx) | Al foil (6 μm) | no | none |
| | III-1 (Ex) | Al foil (6 μm) | yes | nonwoven Al cloth with areal density of 550 g/m$^2$ |
| | IV-1 (CEx) | none | | nonwoven Al cloth with areal density of 550 g/m$^2$ |
| 2 (FIG. 8) | I-2 (Ex) | Al foil (15 μm) | yes | none |
| | II-2 (CEx) | Al foil (15 μm) | no | none |
| | III-2 (Ex) | Al foil (15 μm) | yes | nonwoven Al cloth with areal density of 550 g/m$^2$ |
| | IV-2 (CEx) | none | | nonwoven Al cloth with areal density of 550 g/m$^2$ |
| 3 (FIG. 9) | I-3 (Ex) | Teflon film (6 μm) | yes | none |
| | II-3 (CEx) | Teflon film (6 μm) | | none |
| | III-3 (Ex) | Teflon film (6 μm) | yes | nonwoven Al cloth with areal density of 550 g/m$^2$ |
| | IV-3 (CEx) | none | | nonwoven Al cloth with areal density of 550 g/m$^2$ |
| 4 (FIG. 10) | I-4 (Ex) | Two Al foils (12 μm) | yes | none |
| | II-4 (CEx) | Two Al foils (12 μm) | no | none |
| | III-4 (Ex) | Al foil (20 μm) + Teflon film (20 μm) | yes | none |
| | IV-4 (CEx) | Al foil (20 μm) + Teflon film (20 μm) | no | none |
| 5 (FIG. 11) | I-5 (Ex) | Al foil (12 μm) + Teflon film (20 μm) | yes | nonwoven Al cloth with areal density of 550 g/m$^2$ |
| | II-5 (CEx) | Al foil (12 μm) + Teflon film (20 μm) | no | nonwoven Al cloth with areal density of 550 g/m$^2$ |

Note: In all samples, the Al foil(s) and/or Teflon film and the porous member (if any) were held between two layers of Al base expanded metal 0.4 mm thich that had openings 20 with a size of 3 mm across the shorter side and a size of 44 mm across the longer side.

EXAMPLE 6

Additional samples of sound absorbing material were constructed by repeating the procedures of Examples 1–3 except that the Al base expanded metal (i) having a thickness of 0.4 mm was replaced by an Al screen that consisted of wires with a diameter of 1 mm and that had openings of 100 mesh. The absorption coefficients of these samples were measured by a normal-incidence sound absorption method for construction materials (JIS 1405-1963).

The results of the measurement were comparable to those obtained in the associated examples and the sound absorbing materials having ruptures in the Al base metal foil or thin resin film exhibited satisfactory sound absorbing characteristics.

As described on the foregoing pages, the sound absorbing materials of the present invention are composite systems that comprise basically an aluminum base expanded metal or an aluminum base screen which are laminated with an aluminum base metal foil and/or a thin resin film such as a thin fluoroethylene or polyvinylidene film, or additionally with an aluminum base metal fiber layer. Since the aluminum base metal foil and/or the thin resin film have ruptures in their structure, the inherent sound-absorbing characteristics of the ordinary aluminum base laminate are combined with the effective membranous vibrations of not only the metal foil and the thin resin film but also their ruptures to achieve even better sound-absorbing characteristics. Further, the sound absorbing materials of the present invention are less expensive and lighter in weight than the prior art sound absorbing materials which are composed of aluminum base composite laminates.

Because of these features, the sound absorbing materials of the present invention can advantageously be used in various applications such as insulation walls on highways, walls in music halls and noise controlling absorbents in factories.

In particular, those sound absorbing materials which use a thin PTFE film exhibit sufficient waterproofness during exposure to weather, so even if glass wool is also used in those sound absorbing materials, it is effectively prevented from absorbing moisture and the initial high sound-absorbing characteristics can be retained during prolonged use in outdoor applications.

What is claimed is:

1. A sound absorbing material comprising an aluminum base expanded metal and/or an aluminum base metal screen which are laminated with an aluminum base metal foil having ruptures adapted to be vibrated by sound waves.

2. A sound absorbing material according to claim 1 wherein said aluminum base metal foil is held between two layers of said aluminum base expanded metal and/or aluminum base metal screen.

3. A sound absorbing material according to claim 2 which includes two layers of said aluminum base metal foil.

4. A sound absorbing material according to claim 3 wherein the openings in the two layers of said aluminum base expanded metal and/or aluminum base metal screen between which the two aluminum base metal foils are held have different sizes.

5. A sound absorbing material according to claim 1 wherein said aluminum base metal foil has a thickness of 4–50 m.

6. A sound absorbing material according to claim 1 which further includes a thin resin film having ruptures adapted to be vibrated by sound waves.

7. A sound absorbing material according to claim 1 wherein said ruptures are slits.

8. A sound absorbing material comprising an aluminum base expanded metal and/or an aluminum base metal screen which are laminated with an aluminum base metal fiber layer and an aluminum base metal foil that has ruptures adapted to be vibrated by sound waves.

9. A sound absorbing material according to claim 8 wherein said aluminum base metal fiber layer and said aluminum base metal foil are held between two layers of said aluminum base expanded metal and/or aluminum base metal screen.

10. A sound absorbing material according to claim 8 wherein said aluminum base metal foil has a thickness of 4–50 $\mu$m.

11. A sound absorbing material according to claim 8 which includes two layers of said aluminum basemetal foil.

12. A sound absorbing material according to claim 8 wherein said aluminum base metal fiber layer is a nonwoven cloth of aluminum fibers.

13. A sound absorbing material according to claim 12 wherein said nonwoven cloth of aluminum fibers has an a real density of 550–1,650 g/m$^2$.

14. A sound absorbing material according to claim 8 which further includes a thin resin film having ruptures adapted to be vibrated by sound waves.

15. A sound absorbing material according to claim 7 wherein said slits are elongated and have lengths that are parallel to each other.

* * * * *